US006209363B1

(12) United States Patent
Jordan

(10) Patent No.: US 6,209,363 B1
(45) Date of Patent: Apr. 3, 2001

(54) PROCESS FOR FACILITATING CLOSURE OF A TUBULAR KNIT ARTICLE

(75) Inventor: Bobby Ray Jordan, Burlington, NC (US)

(73) Assignee: B.B. & T. Knitting, Ltd., Nassau (BS)

( * ) Notice: Subject to any disclaimer, the term of this patent is extended or adjusted under 35 U.S.C. 154(b) by 0 days.

(21) Appl. No.: 09/405,992

(22) Filed: Sep. 27, 1999

Related U.S. Application Data

(60) Continuation-in-part of application No. 08/797,797, filed on Feb. 7, 1997, which is a division of application No. 08/797,797, filed on Feb. 7, 1997, now Pat. No. 6,003,345

(60) Provisional application No. 60/034,705, filed on Jan. 3, 1997.

(51) Int. Cl.[7] ..... D04B 9/56

(52) U.S. Cl. ..... 66/215; 66/187

(58) Field of Search ..... 66/8, 9 R, 13, 66/17, 20, 25, 215, 171, 128 R, 184, 186, 187

(56) References Cited

U.S. PATENT DOCUMENTS

| | | | | |
|---|---|---|---|---|
| 2,069,021 | | 1/1937 | Schuessler . | |
| 2,522,842 | | 9/1950 | Scholl . | |
| 2,926,513 | | 3/1960 | Tew . | |
| 2,980,917 | | 4/1961 | Slane . | |
| 3,520,262 | | 7/1970 | Bolles et al. . | |
| 3,601,818 | | 8/1971 | Cheseboro et al. . | |
| 3,626,727 | | 12/1971 | Wood et al. . | |
| 3,721,111 | | 3/1973 | Billi . | |
| 3,796,067 | | 3/1974 | East . | |
| 3,800,559 | * | 4/1974 | Fecker | 66/187 |
| 3,800,563 | | 4/1974 | Billi . | |
| 4,014,186 | | 3/1977 | Ferraguti . | |
| 4,028,910 | | 6/1977 | Wignall et al. . | |
| 4,037,436 | | 7/1977 | Wehrmann . | |
| 4,047,401 | | 9/1977 | Nurk . | |
| 4,055,201 | | 10/1977 | Fowler et al. . | |
| 4,958,507 | * | 9/1990 | Allaire et al. | 66/187 |
| 5,398,626 | | 3/1995 | Rosso et al. . | |
| 6,003,345 | | 12/1999 | Jordan . | |

* cited by examiner

*Primary Examiner*—Danny Worrell
(74) *Attorney, Agent, or Firm*—Alston & Bird LLP

(57) ABSTRACT

A method for facilitating in seaming closed an open end of a generally tubular structure is described. The method involves providing first and second handles extending from opposite sides of an open end of the tubular structure, extending the first and second handles in opposing directions to thereby flatten the tubular structure upon itself and align opposing faces of the tubular structure so that the open end terminates along a common edge. The open end can then be seamed by sewing or other securement methods, to thereby form a closed end on the tubular structure. The first and second handles can be integrally formed as a bridge extending across the open end of the tubular structure, and subsequently severed to form a free end on each of the handles. The tubular structure can be circular knit, with the bridge being formed during the knitting process through the formation of long floats extending a substantial distance around the circumference of the open end of the tubular structure. The method is particularly useful in the manufactured of closed-toed hosiery.

20 Claims, 3 Drawing Sheets

PROCESS FOR FACILITATING CLOSURE OF A TUBULAR KNIT ARTICLE

CROSS-REFERENCE TO RELATED APPLICATIONS

This application is a continuation-in-part of U.S. patent application Ser. No. 08/797,797, filed Feb. 7, 1997, U.S. Pat. No. 6,003,345, and of U.S. patent application Ser. No. 09/076,470, filed May 12, 1998, now abandoned, a divisional of the '797 application, which is abandoned. The disclosures of each of application Ser. Nos. 08/797,797 and 09/076,470 are incorporated herein by reference. Each of these applications claims the benefit of the filing date of U.S. Provisional Patent Application Serial No. 60/034,705, filed Jan. 3, 1997, the disclosure of which is also incorporated herein by reference.

FIELD OF THE INVENTION

The invention generally relates to a method for facilitating the closure of an open end of a tubular article. More specifically, the invention is directed to a method for facilitating the seaming closure of a tubular knit article such as the toe end of an item of hosiery.

BACKGROUND OF THE INVENTION

In the manufacture of tubular products such as knit hosiery, it is generally necessary to close one end of the tubular structure to form the toe end of the finished product. (For purposes of this application, the term "hosiery" is meant in its broadest sense, and is intended to encompass all types of hosiery articles such as socks, ladies stockings, and the like.) Hosiery articles are conventionally manufactured on either single or double-cylinder circular knitting machines. This operation is typically performed by sewing opposite sides of the open end of the tubular structure together to form a toe pocket of the hosiery article. In some varieties of hosiery, both of the opposite sides of the tubular structure are substantially the same length, so that the toe seam is located on the end of the finished product. In this way, when the hosiery article is positioned on a wearer's foot, the seam is located proximate the ends of the wearer's toes. This construction is primarily used in the manufacture of ladies' sheer hosiery.

In many cases, however, it is desired to have the seam located other than at the ends of the toes, and/or it is also desired to have a structure which more closely corresponds to the three-dimensional shape of a wearer's foot. In such embodiments, one side of the tubular structure is knit so as to have a greater dimension than the opposite side of the tubular structure. This is usually achieved by knitting a tubular structure in a circular fashion, then where extra material is desired, knitting in a reciprocating fashion to provide additional knit courses on one side of the tubular structure. For example, reciprocation is often performed at two spaced-apart regions on one side of the tubular structure, to form a heel pocket and a toe pocket for the wearer's heel and toes, respectively. Because of the extra knit courses formed on one side of the knit structure, when opposite sides of the tubular structure are subsequently joined together to form a closed toe end, the toe-forming seam is positioned on one side (e.g. the top) of the finished stocking. In this way, the toe portion of the stocking can be manufactured to closely follow the contours of the human foot, and the seam can be located at a position where it is unlikely to cause irritation to the wearer's foot when the stocking is worn.

In many sock manufacturing operations, the tubular structures are knit, then transferred to a centralized toe-closing area. Each sock is manually placed by an operator onto a turner which turns the sock inside out. Each sock is then manually placed on a high speed sewing machine which sews the toe together. When placing the sock on the sewing machine, the operator must manually line up the opposite sides of the tubular structure such that the "corners" (formed where the circular knitting stops and the reciprocating knitting starts) are properly oriented to form a properly-shaped pocket and the ends of the opposite sides of the tubular structure are aligned relative to each other. The toe is then seamed closed, and the sock is then turned either manually or by the sewing machine so that the sock is right side out.

Another commercially-utilized method for closing the toes of articles of hosiery involves using a dual bed knitting machine (i.e. one having both a cylinder and a dial) and transferring the last stitch onto the dial. The dial folds in half so that the toe opening is properly aligned for seaming, and the sock is off-loaded from the machine while the stitch is still attached and the opening sewn closed. Some disadvantages with this process are that it requires new machines (i.e., it cannot be done on existing machines), and the purchase price, maintenance, and upkeep costs are generally more expensive than with a standard machine.

Another method used to manufacture socks involves knitting a shaped toe portion on the machine by starting the knitting process at the toe portion rather than at the cuff in the conventional manner. However, this method results in raveling being experienced at the cuff portion, which typically necessitates the provision of an extra band of knitting at the top of the sock. As a result, socks produced in this manner can have an uncomfortable fit which is not smooth. In addition, the machines are generally more expensive than the conventional machines and can be more expensive to maintain. Furthermore, the socks produced by this method have a toe seam on the outside of the sock, which can be aesthetically unappealing.

Because most toe closing operations typically require removal of the tubular structure from the knitting machine, alignment of opposite sides of the structure at the open end and sewing, they are generally relatively labor intensive, and therefore can represent a significant factor in the manufacturing cost of stockings. Furthermore, the toe seaming step, due in part to its labor intensiveness, provides the opportunity for the creation of defects (e.g. by the improper alignment of the opposite sides of the open end of the tubular structure), which can lead to the formation of "seconds" which in turn cannot be sold at the same price as first quality items.

Because circular weft knit fabrics unravel from the last portion knitted, stockings are generally knit starting with the cuff and ending at the toe. A non-raveling region or "clip' is therefore typically knit to the open end of the toe portion so that the open end will be sufficiently stable to allow for the toe closing operation.

Examples of prior attempts to automate the process of closing the ends of stockings are described in patents as follows:

U.S. Pat. No. 2,926,513 to Tew describes a method of closing a toe of a stocking, where the machine engaged in continuous circular knitting is converted to reciprocating knitting. During the reciprocating knitting, certain of the needles are disengaged while the remaining needles continue the knitting operation. Continuous circular knitting is resumed as all needles are engaged for the knitting operation and the toe portion is completed. The tubular foot portion is manually folded flat, with care being taken to ensure the gores of the toe pocket are in registration and the opening is seamed closed.

U.S. Pat. No. 3,800,559 to Fecker describes a method for closing the toes of stockings on conventional circular knitting machines. A toe-closing thread is knit into the toe end of a tubular mesh. The mesh is then cast off the needles of a circular knitting machine and the closing thread is pulled or partially drawn out of the mesh, causing the mesh to be constricted, thereby closing the toe. The closing thread is then knotted to prevent withdrawal of the thread.

U.S. Pat. No. 4,014,186 to Ferraguti describes a method for forming a closed end of a tubular knit sock on a circular knitting machine. Two annular tubular layers are formed as continuations of the tubular knit fabric at separate stages by needles operating in the same cylinder of the machine. The loops at the free edge of the inner layer are held on a support arranged in a circle and the free edge of the inner layer is held on support members arranged in a circle. The free edge of the outer layer is held by the needles until a relative rotation of at least 180 degrees between the circle of support members and the cylinder has been effected. The loops held onto the support members are transferred to the needles of the cylinder, and a final few rows are knit before the fabric is removed from the needles to thereby close the end of the tubular knit fabric.

U.S. Pat. No. 4,958,507 to Allaire et al. describes a method for closing the toe of a double-layered sock. A first course knit by needles corresponding to the end of the tip of a first layer is transferred onto a central transfer plate of a machine where the sock is held. Knitting of the first layer continues from the tip to the mock-up edges. Then knitting is continued on the mock-up edges of the second layer to the tip, the knit tubular structure being suspended by one circular end from the central transfer plate and by the other circular end from the needle cylinder in the course of work, shaping the two concentric layers within each other. The initial course in standby on the plate is transferred to the needles of the cylinder to join the two layers together, and the toe is joined together by knitting.

An additional alternative which has been proposed involves adapting small linking machines to become knitting machines. The stocking is removed from the needles by a split dial and linked onto the knitting machine. While this method can provide satisfactory end closure without operator intervention, many types of existing equipment are not readily adaptable to this conversion. Also, substantial costs are involved in converting the equipment resulting in additional maintenance.

Therefore, a need exists for a method of closing the ends of tubular articles, and in particular, for closing the ends of items of hosiery, which can be performed with minimal labor input and using conventional equipment.

SUMMARY OF THE INVENTION

With the foregoing in mind, the instant invention facilitates the seaming of an open end of a tubular structure, and in particular, that of a knit stocking, by simplifying the alignment step of the seaming operation.

More specifically, the instant invention involves the provision of first and second handles along opposite sides of the open end of a tubular structure which is to be closed, so that when the handles are extended away from each other, the tubular structure is flattened and the edges of the open end along the opposite faces of the tubular structure automatically aligned with each other. In this way, the structure can be readily seamed together to form a closed end on the tubular article, with increased accuracy and efficiency.

The handles can be provided in a variety of ways. In one aspect of the invention, the tubular structure is circularly knit and the handles are integrally formed with the tubular structure. In a preferred method for producing this embodiment of the invention, the tubular structure is circularly knit, then a yarn is knit onto a small number of needles (e.g. one to five) on one side of the knitting cylinder, then the yarn is not knit onto the next substantially greater number of needles until it reaches the opposite side of the cylinder from where it previously knit. The yarn is then knit onto a small number of needles on that side of the cylinder. This knitting arrangement results in a long float or "bridge" extending from a first side of the tubular structure to the opposite side of the tubular structure. The yarn then again passes over a number of needles without knitting, as it proceeds around the cylinder in the same direction until it reaches the region of the cylinder corresponding to where it first knit on only a small number of needles. The yarn is then knit onto a small number of needles at this position (e.g. such as one to five), which can be the same needles which were previously knit upon. The process is then desirably continued for several revolutions around the knitting machine, so that the thus-formed bridge includes a number of long floats. In a preferred form of the invention, the tubular article has a substantially 360 degrees circumference, and opposite ends of the bridge are secured approximately 180 degrees around the circumference from each other.

The bridge defines two handles; the bridge is desirably severed proximate its center in order that it forms two handles having free ends. In this way, the handles can be readily and easily formed during the process of knitting the tubular article itself, and the bridge can be used to assist in the transfer of the tubular article from the knitting machine to the next processing station, as well as assist in inverting the article for seaming.

In alternative embodiments of the invention, the handles can be provided in the form of plastic or other types of straps or bands. These handles can be provided as discrete separate bands or can have opposite ends secured together to form a bridge traversing the open end of the tubular structure.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
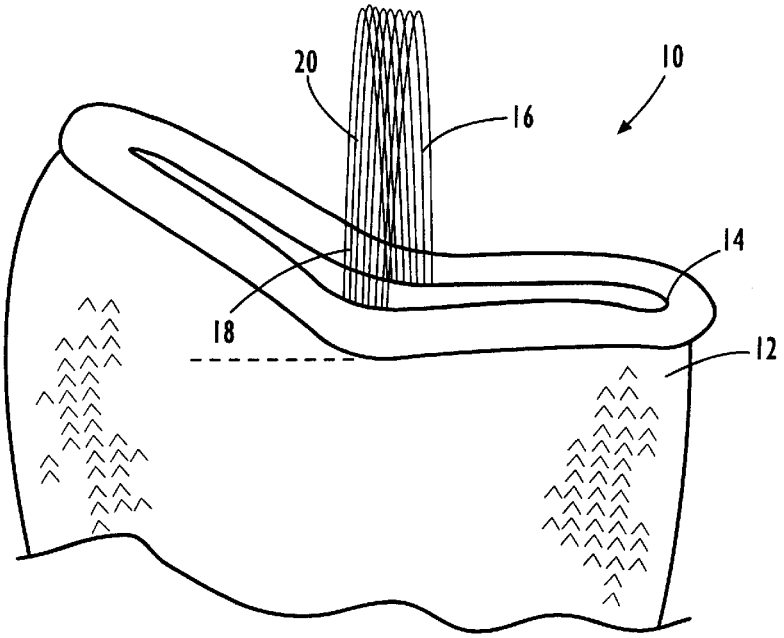
FIG. 1 is a perspective view of a portion of a tubular structure according to the instant invention.

With reference to the drawings, FIG. 1 illustrates one embodiment of the instant invention, which is in the form of a section of a blank which can be used to form an item of hosiery, such as a sock. The blank, shown generally at 10, includes a tubular structure 12 which terminates in at least one generally circular open end 14. The open end 14 desirably has a substantially 360° circumference. (Although referred to as "generally circular" and "circumference", it is noted that these terms are meant to describe that the structure is adapted to substantially entirely surround an interior region, and is intended to cover such configurations as a somewhat or generally flattened circular structure, and the like.)

A first handle 16 is secured proximate the open end 14 of the tubular structure 12 at a first position and extends outwardly from the open end. A second handle 18 is desirably secured proximate the open end 14 of the tubular structure at a second position, with the second position being located proximate the open end 14 at a location generally opposite that of the first position. In a preferred form of the invention, the open end 14 defines a substantially 360° circumference, and the first and second handles 16, 18 are secured at the respective first and second positions so that the positions are spaced from each other about 180° from each other along the circumference of the tubular structure. In this way, the handles 16, 18 are spaced from each other approximately the same distance in each direction around the open end 14.

In one aspect of the invention, the first and second handles 16, 18 are initially integrally formed with each other, and provided to the tubular structure 12 in the form of an integral bridge 20 traversing the open end 14 of the tubular structure. It has been found that this, in some aspects of the invention, serves to simplify the manufacturing process, as the two handles can thus be provided in a single operation. In these embodiments, the bridge 20 is subsequently severed to form discrete handles 16, 18, with each of the two handles having a free end 16*a*, 18*a*, as will be discussed in more detail further herein. Alternatively, the handles 16, 18 can be individually provided from the outset in the form of two individual discrete pieces.

Figure 2:
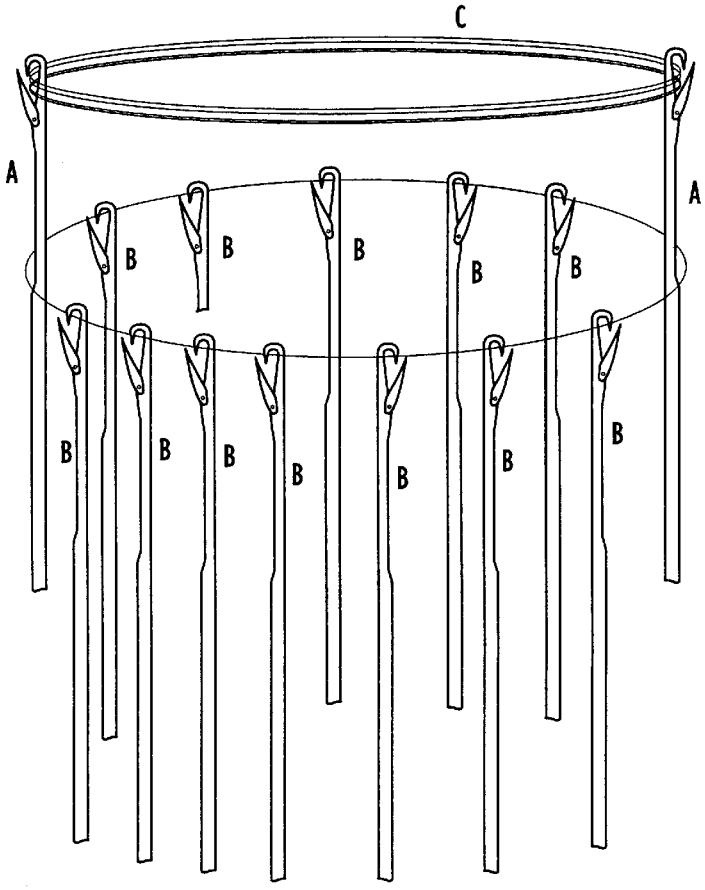
FIG. 2 is a schematic representation of a needle arrangement and stitch configuration on a knitting machine, which can be used to integrally knit the two handles on a tubular article.
Figure 3:
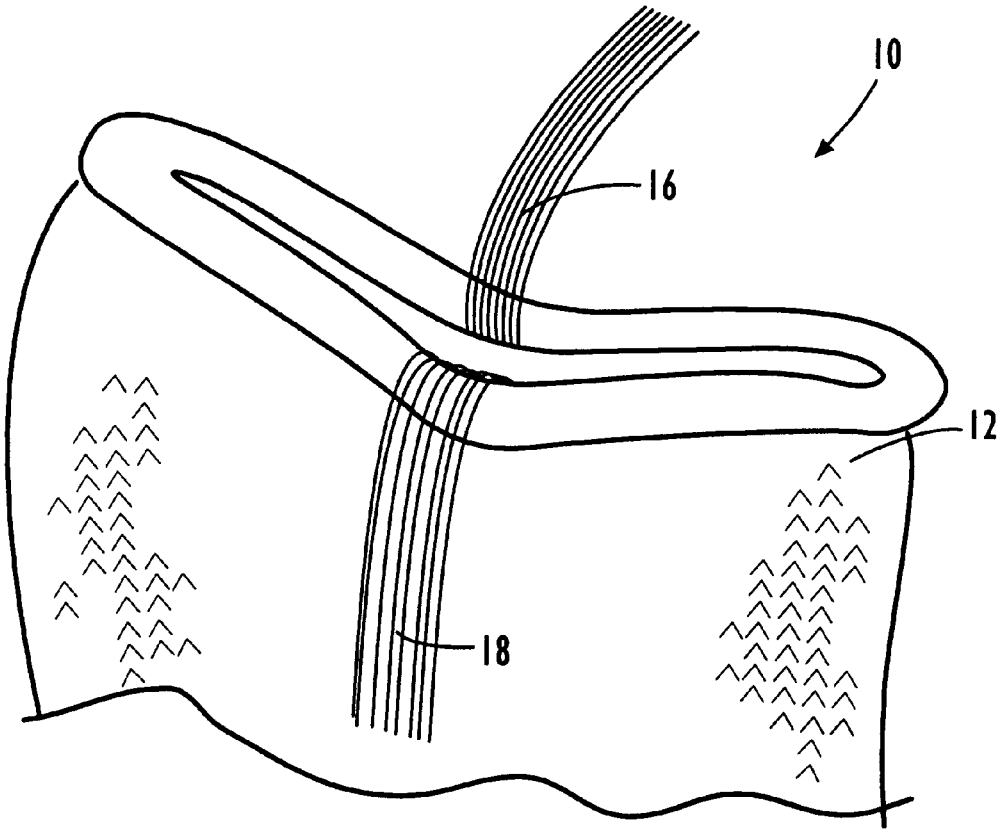
FIG. 3 is a perspective view of a portion of a tubular structure, illustrating the first and second handles in their separated form.
Figure 4:
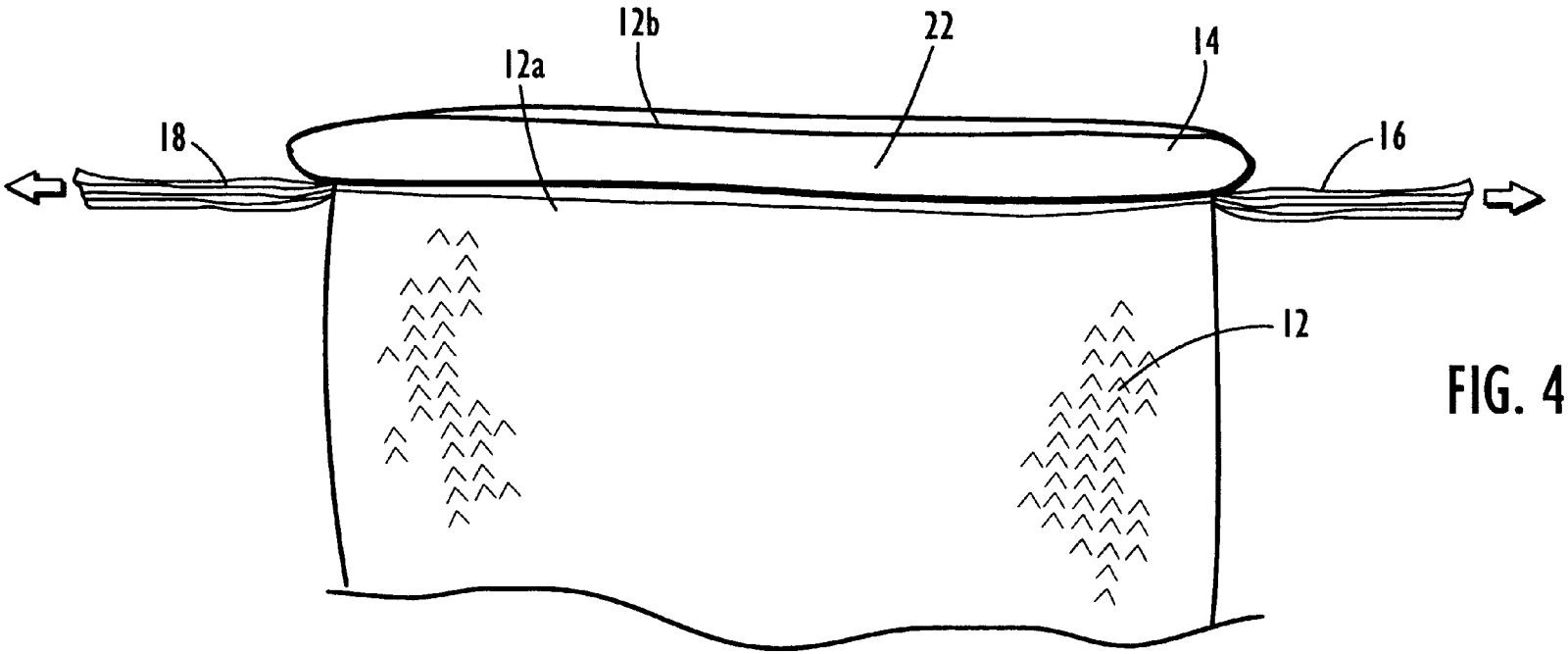
FIG. 4 is a perspective view of a portion of the tubular structure of FIG. 3, as it appears when the first and second handles are extended in opposite directions so as to flatten the tubular structure.

In a form of the invention particularly useful in forming garments such as items of hosiery, the tubular structure 12 is desirably circularly knit, and the handles 16, 18 are integrally knit during the knitting process forming the tubular structure. For example and as illustrated in FIG. 2, the tubular structure 12 can be knit in a known manner to include an open end 14. As the knitting cycle approaches the formation of the knit courses forming the open end 14 of the tubular structure 12, one or more yarns can be knit into a relatively small number of needles on the machine (i.e. one or greater), then the yarn will not be knit again until it reaches the opposite side of the knitting cylinder, where it is again knit into one or more needles. Because a relatively large number of needles are "skipped over", the result is an elongated piece of yarn in the form of a bridge extending from one side of the tubular structure to the other side of the tubular structure. In other words, the yarn Y is knit into one or more needles on one side of the knitting cylinder, then "floated" over a number of needles (which are in their inoperative state so that the yarn does not knit on those needles), until it reaches the opposite side of the cylinder, where the yarn then forms a knit loop on at least one needle so that the yarn is secured to the opposite side of the tubular structure. The yarn Y is then desirably floated over a number of needles on the opposite circumferential side of the knitting machine cylinder (i.e., the yarn continues to be fed in the same direction around the knitting machine cylinder) until it reaches needles proximate the initial needles where the yarn Y was knit, where it again formed knit loops on one or more needles, to again sure the yarn to the tubular structure. At this point, first and second floats are then formed, with each having its opposite ends secured to the tubular structure so that each float bridges the open center of the tubular structure. In a preferred form of this embodiment of the invention, the yarn Y is knit into more than one needle on each side of the cylinder, so that each end of each of the floats is secured by more than one stitch, as it is believed that this will reduce distortion in the tubular structure. In another aspect of the invention, the yarn Y is secured by knitting on every other needle to form the points of securement of the floats to the tubular structure. For example, it has been found that in the production of a sock blank, it works well to form the bridge by knitting the yarn on 3 out of 5 adjacent needles so that the yarn knits on every other needle. An example of the invention is shown in FIG. 2, where the yarn Y can be knit into a needle A, then floated across a number of subsequent needles B, then knit on a second needle A (which is located on an opposite side of the knitting cylinder.) In this way, each of the float ends is secured within the knit fabric structure as the tubular structure 12 is produced.

This process is desirably repeated for several courses, such that a plurality of elongated floats are formed. For example, in the production of an article of hosiery for a human wearer, the yarn Y can be knit on 4–5 needles on one side of a circular knitting cylinder then floated across the intervening needles until it is knit onto 4–5 needles on the opposite side of the cylinder of the knitting machine. As the yarn then continues being fed in the same direction (e.g. either clockwise or counter-clockwise around the knitting cylinder), it is floated across the intervening needles and knit into the same 4–5 needles where it was originally knit. The same pattern is desirably repeated for 4–5 courses, with the result being the formation of a plurality of elongated floats formed on opposite sides of the tubular structure proximate its open end.

In a particularly preferred form of the invention, the active needles A (which can be one or more needles on each side of the knitting cylinder) are positioned on the knitting cylinder at a position substantially 180° from each other, so that the point of float securement is accomplished at opposite sides of the tubular structure. In this way, the handles are secured so as to be substantially the same distance apart regardless of which direction around the circumference of the open end the distance is measured. This needle selection can be performed using conventional patterning mechanisms on commercially available machines, the programming of which will be readily understood by those having ordinary skill in the art.

One or more courses are then desirably knit subsequent to the courses forming the elongate floats, so as to form a relatively small margin 22, which forms a seam allowance when the open end of the tubular structure is subsequently seamed closed.

Where the handles of the instant invention are used during the formation of a item of fitted hosiery, the tubular structure can be reciprocatingly knit in a conventional manner to form extra courses which in turn form shaped toe and/or heel pockets. Where a shaped toe pocket is utilized, the tubular structure can be knit using the needles around the entire cylinder of the knitting machine, then the reciprocation begun to form extra courses along one face of the tubular structure. The courses forming the bridge 20 are then desirably knit in the manner described above, and can be provided so that the points of securement of the handles on the tubular structure correspond to the position where the reciprocating courses are begun. In this way, the handles can be secured proximate the juncture of the reciprocated toe pocket with the circularly knit portion of the tubular structure.

In alternative embodiments of the invention, the handles can be provided in the form of plastic or other types of straps or bands. These handles can be provided as discrete separate bands or can have opposite ends secured together to form a bridge traversing the open end of the tubular structure. Such straps or bands can be secured to the tubular structure in any known manner, such as by inserting a shaped end through the tubular structure in the manner in which hanging pricetags are secured to garments within a store. Another method which could be used is to circularly knit a tubular structure, stop the knitting process briefly to allow the insertion of the two handles (such as by dropping in a hang-tag-type loop between needles on the knitting machine), then proceeding with the knitting operation to form a knit margin which can be used to retain the plastic hang-tag-type loop within the knit structure. Where the handles are integrally formed as a bridge traversing the open end of the tubular structure, the bridge is then severed so that each handle includes a free end 16*a*, 18*a*.

In one form of the invention, the handles are provided proximate the open end at a position slightly spaced from the terminal edge of the open end. In this way, a small margin 22 is provided, which forms a seam allowance when the open end of the tubular structure is subsequently seamned closed.

The free end 16*a*, 18*a* of each of the respective handles is then grasped, either by a machine or an operator, and one or both of the handles are extended so that the respective handles are extended in opposite directions. This causes the tubular structure to flatten upon itself, with the opposite faces 12*a*, 12*b* of the tubular structure assuming an aligned configuration so that the opposite faces of the open end of the structure terminate along a common plane. The opposite faces of the open end of the tubular structure can then be seamed together, to readily and easily form a neat and accurately-aligned closed end of the structure.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for producing a tubular article comprising the steps of:

providing a tubular structure having at least one generally circular open end;

forming a first elongate handle at a first position on said open end;

forming a second elongate handle at a second position on said open end, said second position being located on said open end at a location generally opposite that of said first position, wherein said first and second handles are provided in the form of an integral bridge bisecting said open end of said tubular structure, and further comprising the step of cutting the bridge so that each of said first and second handles has a free end.

2. A method for producing a tubular article comprising the steps of:

providing a tubular structure having at least one generally circular open end;

forming a first elongate handle at a first position on said open end;

forming a second elongate handle at a second position on said open end, said second position being located on said open end at a location generally opposite that of said first position, and further comprising the step of extending said first and second handles in opposing directions, to thereby flatten the tubular structure upon itself and align opposing faces of the tubular structure so that said generally circular open end terminates along a common edge.

3. A method for closing an open end of a tubular structure comprising the steps of:

providing a tubular structure having a generally circular open end and first and second handles extending outwardly from generally opposite sides of said open end;

grasping and extending the handles in generally opposite directions to thereby flatten the tubular structure upon itself and align opposing faces of the tubular structure so that said generally circular open end terminates along a common edge; and seaming opposing faces of the tubular structure so as to close said open end.

4. A method for closing an open end of a tubular structure according to claim 3, wherein said step of providing a tubular structure having a generally circular open end comprises providing a knit tubular article.

5. A method for closing an open end of tubular structure according to claim 4, wherein said step of providing a knit tubular article comprises providing a knit tubular article having first and second integrally knit handles.

6. A method of forming a tubular garment on a knitting machine, the method comprising:

(a) orientating the garment with an opening disposed relative to one end on the knitting machine;

(b) forming a yarn bridge across the opening of the garment, the bridge being affixed to the garment at a first and a second site, the first and second sites being disposed near the opening, exact positioning of the first and second sites relative to the opening being predetermined in accordance with the orientation of the garment on the knitting machine, the first site opposing the second site; and (c) dividing the bridge forming a first and second handle, the first handle being affixed at the first site and the second handle being affixed at the second site, the first and second handles being useful for further processing of the garment.

7. The garment manipulation method of claim 6, further comprising grasping the first and second handle, pulling the first handle away from the second handle thereby drawing together a first lip portion to a second lip portion of the garment enabling the first lip portion to be attached to the second lip portion, the first lip portion opposing the second lip portion, the first lip portion being disposed between the first and second handles, the second lip portion being disposed between the second and first handles.

8. The garment manipulation method of claim 7, further comprising grasping the first and second handle and inverting the garment.

9. The garment manipulation method of claim 6, further comprising grasping the first and second handle and inverting the garment.

10. The garment manipulation method of claim 6, where in the bridge is inserted by selecting at least one needle on each side of the garment, and marking specific sites of the garment on a circular knitting machine.

11. The garment manipulation method of claim 6, wherein the garment has a hollow and generally cylindrical shape.

12. The garment manipulation method of claim 6, wherein the general shape of the garment is asymmetrical.

13. The garment manipulation method of claim 6, wherein the garment is inverted during the orientation.

14. A method of manipulating a garment on a knitting machine, the method comprising:

(a) orientating the garment on the knitting machine with an opening disposed therein;

(b) attaching a bridge near an open end of the garment, the bridge being made of a material different than the garment material, the bridge being secured to a first site and a second site, the first and second sites being disposed near the open end of the garment, exact positioning of the first and second sites relative to the opening being predetermined in accordance with the orientation of the garment on the knitting machine, the first site opposing the second site; and (c) dividing the bridge forming a first and second handle, the first handle being affixed at the first site and the second handle being affixed at the second site, the first and second handles being useful for further processing of the garment.

15. The garment manipulation method of claim 14, further comprising grasping the first and second handle, pulling the first handle away from the second handle thereby drawing together a first lip portion to a second lip portion of the garment enabling the first lip portion to be attached to the second lip portion, the first lip portion opposing the second lip portion, the first lip portion being disposed between the first and second handles, the second lip portion being disposed between the second and first handles.

16. The garment manipulation method of claim 14, further comprising grasping the first and second handle and inverting the garment.

17. The garment manipulation method of claim 14, further comprising grasping the first and second handle and inverting the garment.

18. The garment manipulation method of claim 14, wherein the bridge of material comprises a wire or plastic cord.

19. The garment manipulation method of claim 14, wherein the general shape of the garment is asymmetrical.

20. The garment manipulation method of claim 14, wherein special fibers with receptive properties and optical sensors disposed at the corners of the opening are used to determine the location of the sites.

* * * * *

UNITED STATES PATENT AND TRADEMARK OFFICE

CERTIFICATE OF CORRECTION

PATENT NO. : 6,209,363 B1
DATED : April 3, 2001
INVENTOR(S) : Jordan

It is certified that error appears in the above-identified patent and that said Letters Patent is hereby corrected as shown below:

Title page,
Item [60] Related U.S. Application Data, cancel "Continuation-in-part of application No.08/797,797, filed on Feb. 7, 1997, which is a division of application No. 08/797,797, filed on Feb. 7, 1997, now Pat. No. 6,003,345" and insert -- Continuation-in-part of application No. 08/797,797, filed on Feb. 7, 1997, now Pat. No. 6,003,345, and 09/076,470, filed on May 12, 1998, now abandoned. --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*